United States Patent [19]

Karrer et al.

[11] 4,369,035

[45] Jan. 18, 1983

[54] PROCESS AND APPARATUS FOR LIQUID TREATMENT OF FIBER MATERIAL

[76] Inventors: Fritz Karrer, Stockholm, Sweden; Alberto Pedretti, Rome, Italy; Per G. Mellgren, Pointe Claire, Canada

[21] Appl. No.: 243,955

[22] PCT Filed: Jul. 11, 1980

[86] PCT No.: PCT/EP80/00048

§ 371 Date: Mar. 5, 1981

§ 102(e) Date: Mar. 5, 1981

[87] PCT Pub. No.: WO81/00266

PCT Pub. Date: Feb. 5, 1981

[30] Foreign Application Priority Data

Jul. 11, 1979 [DE] Fed. Rep. of Germany ..... 2928012
Oct. 5, 1979 [DE] Fed. Rep. of Germany ..... 2940470

[51] Int. Cl.[3] ..... D06L 3/00

[52] U.S. Cl. ..... 8/101; 8/149.1; 8/155; 8/158; 8/919; 68/207

[58] Field of Search ..... 8/149.1, 155, 158, 101

[56] References Cited

U.S. PATENT DOCUMENTS

| | | | |
|---|---|---|---|
| 3,631,691 | 1/1972 | Karrer et al. | 68/20 |
| 3,692,464 | 9/1972 | Furness | 8/149.3 |
| 3,695,827 | 10/1972 | Byrd | 8/155.2 |
| 3,871,821 | 3/1975 | Winn et al. | 8/155.1 |
| 3,960,487 | 6/1976 | Stritzko | 8/155.1 |
| 3,967,923 | 7/1976 | Ameling | 8/149.1 |

*Primary Examiner*—A. Lionel Clingman
*Attorney, Agent, or Firm*—Michael J. Striker

[57] ABSTRACT

Particularly uniform and rapid dyeing of textile material is achieved, subsequent to feeding the dyeing liquor into a processing container filled with the textile material and heating the dyeing liquor approximately to boiling temperature, by a gradual lowering of the container pressure by means of a regulating device and/or by supplying the dyeing liquor with heat by means of a temperature regulating arrangement, so that the dyeing liquor will be kept boiling slowly and steadily at partial evaporation, and the rising steam bubbles will agitate the dyeing liquor without requiring induced circulation by means of a pump or similar, and bring the dyeing liquor into intimate contact with the textile material. The dyeing process may be aided by a pulsating motion of the dyeing liquor. In certain instances, all energy required is supplied in the form of steam.

12 Claims, 4 Drawing Figures

PROCESS AND APPARATUS FOR LIQUID TREATMENT OF FIBER MATERIAL

BACKGROUND OF THE INVENTION

The invention relates to liquid treatment of fiber material and concerns, for instance, the dyeing or bleaching of yarn in the shape of crosswound bobbins, or pieces in the shape of rolls, or also loose material which, for instance, may be treated when packaged, with the invention having herein its objective in achieving a treatment time shorter than required hitherto, and effecting savings by reducing expenditure.

It is known how to perform liquid treatment of fiber material, for instance dyeing and bleaching of textile material, by applying a vacuum in such a manner that the material to be treated is placed into a container, the container evacuated and the preheated treatment fluid then filled into the container, as described in DE Letters Patent No. 19 27 651 and the corresponding U.S. Pat. No. 3,631,691. Since the air contained in the material is removed to the greatest extent by evacuation, the fluid will penetrate the material with greater facility. During the subsequent treatment phase, the fluid is then circulated by means of a pump arranged outside of the container and connected to two chambers arranged within the container, with both chambers being in communication only through the fiber material to be treated, so that, respectively, the treatment liquor or fluid will forcibly be conducted through the material under treatment and the treatment fluid will come into as close as possible a contact with the entire fiber material. This mechanically induced fluid flow will require a considerable quantity of mechanical energy and also costly equipment of the apparatus with a pump, piping and valves, the more so since it has been found that a repeated change of the direction of flow through the fiber material is required in order to obtain the highest possible degree of uniformity in the treatment of the fiber material.

SUMMARY OF THE INVENTION

The aforenoted measures as known have already resulted in shortening the treatment time. The invention is based upon the finding that the treatment process may further be shortened and simplified without impairing the success of treatment, when treatment fluid is filled into the container after it has been evacuated, and by subsequently obtaining partial evaporation of the preheated treatment fluid by a reduction of pressure which will result in an intensive motion of the fluid without the need for mechanically induced fluid motion. If the pressure is lowered by a requisite degree, evaporation will ensue within the entire fluid volume and particularly within the fluid absorbed by the fiber material, so that, respectively, a fluid motion or agitation is obtained to accelerate treatment.

Accordingly, the invention provides a process for the liquid treatment of fiber material, particularly for dyeing and bleaching of yarn or textile piecegoods, wherein the fiber material is placed into a container and the preheated fluid filled into the container, in given instances after said container has been evacuated, with the fiber material being impregnated thereby, this process being characterized by the fluid filled into the container effecting, in essence, a motion caused by partial topical evaporation and thus acting upon the fiber material without requiring a mechanically induced flow.

Appropriate embodiments of the process are evidenced from the subordinate claims.

Treatment or, respectively, the activity of the fluid, may take place at subatmospheric, atmospheric, or superatmospheric pressure (static superatmospheric pressure within the system), so that the treatment temperature desired in each individual instance may be maintained.

Partial evaporation during the treatment phase will lead to lowering the treatment-fluid temperature. Such lowering may be accepted in certain circumstances. Since, however, severe cooling down of the fluid will occur in finishing (dyeing and bleaching) in spite of a relatively short treatment time, it will be appropriate to supply the fluid with a quantity of heat that will compensate the thermal loss, and this may be effected by introducing condensing steam into the fluid, so that in given instances the process may be thermally regulated without having to heat the fluid by external means.

The process may be performed with one single fluid charge, in given instances the process may also be repeated or, respectively, applied repeatedly by dewatering the fiber material with the aid of a vacuum pump and, possibly, also by an additional compressed-air supply and by again effecting vacuum impregnation of the fiber material by using the recovered balance of the fluid, with a further treatment phase subsequently ensuing during gradual and uniform partial evaporation of the fluid. In given instances, de-moistening of the material between the two treatment phases may be dispensed with, and the dyeing process may also be aided by a pulsating fluid motion induced by the vacuum pump as provided herein.

Subsequent to vacuum impregnation in the bleaching process, reheating of the bleaching substrate after the excess fluid has been drawn off, may be effected in the known manner with cold bleaching liquor and by reheating the impregnated material by means of an air-steam mixture.

After conclusion of the finishing process, the material may remain in the container, and undergo very effective rinsing in the shortest time by mechanical dewatering, using the vacuum pump provided, and by repeated drawing-in of water. The fiber material may also be dried in the container within the shortest time, for which purpose warm air and/or an air-steam mixture are drawn through the fiber material, as described in the aforenamed Letters Patent.

Dyeing may be performed particularly simply and at moderate expenditure for apparatus, when all energy required is supplied only in the form of steam that is directly conducted in. This method will allow not only to supply the quantity of heat required for heating the fluid, but also to utilize the steam pressure for generating a pulsating motion to aid in the dyeing process and, furthermore, in given instances, to achieve a pressure reduction by condensation of the steam which is in equilibrium with the dyeing liquor, with said pressure reduction ensuring a slow, continued, boiling (partial evaporation) of the dyeing liquor.

The advantages of the process as per invention, and of the corresponding apparatus, concern the following points:

- considerable energy savings
- lowered cost of the apparatus
- savings in treatment time highest possible preservation of the fiber material due to short treatment time with minimal fluid motion and stationary substrate; no formation of lint, no formation of foam, no danger of coagulation; small bleaching and boiling shrinkage increased uniformity in the effect of treatment due to dispensing with induced fluid circulation.

It is to be taken into consideration that the success of treatment is governed by achieving intimate contact between treatment fluid, for instance a dyeing liquor, and fiber material, said contact being caused by the agitation of steam bubbles generated and raising during partial evaporation, so that it is desirable for the generation of steam bubbles to ensue, as far as possible, in uniform distribution over the volume of fiber material. Generation of steam bubbles is, however, particularly dependent upon topically prevailing pressure and temperature values, wherein it is impossible to avoid moderate fluctuations of these values, taking into regard differing fluid levels in the container or, respectively, within the volume of fiber material. It may, therefore, be of advantage for further improving the activity of the treatment fluid upon the fiber material, to displace the fiber material during partial evaporation in a continual and slow circulation through the container. All zones of the fiber material will, thereby, pass through the zones of varying intensities of fluid activity, and thus result in a particularly uniform treatment.

In instances where the fiber material is to undergo motion, it will be of advantage if the container is only partially filled with the fluid, and the fiber material is displaced along an essentially vertical path, wherein the fiber material will alternatingly be submersed into the fluid and rise out of it. The circulatory motion of the fiber material is herein being utilized for reducing the required quantity of treatment fluid. Furthermore, a particular advantage will result herein since the intensive activity upon the fiber material, primarily resulting from continual fluid evaporation, will be aided by the effect of gravity acting upon the fluid remaining within the fiber material after same has risen from the fluid bath.

If, with circulating fiber material, the treated fiber material is to be rinsed within the container in the manner as known per se, and to be dewatered by evacuation of the container and/or blowing through of air, it will be of advantage to perform rinsing with the container only partially filled with rinsing water, and simultaneously also to dewater, so that the fiber material, when travelling along its essentially vertical circulating path, will alternatingly be rinsed within the lower container zone and dewatered within the upper container zone.

The invention also relates to apparatus deriving from the claims. An appropriate apparatus, particularly if designed with rotatable holder for the fiber material, will allow attaining intensive fluid activity with uniform effect upon the entire fiber material by means of partial evaporation and without external mechanical means to induce circulation. Slow and uniform partial evaporation during the treatment time may be achieved herein by regulating the steam supply in correlation with the pressure in the treatment container on one hand, and the treatment fluid temperature on the other. Isothermal operation is particularly possible in this process, so that it is possible to operate with essentially unchanged temperature and pressure conditions prevailing within the treatment container. Appropriately, the treatment container should be of longitudinal extent, with its longitudinal axis of essentially horizontal orientation. The static-pressure differentials within the fluid in the container are being held small thereby, and the available container volume may be optimally utilized, particularly with a material holder rotatable about a horizontal axis.

Embodiments of the invention are described below with the use of a schematic drawing.

DETAILED DESCRIPTION OF THE PREFERRED EMBODIMENTS

Figure 1:
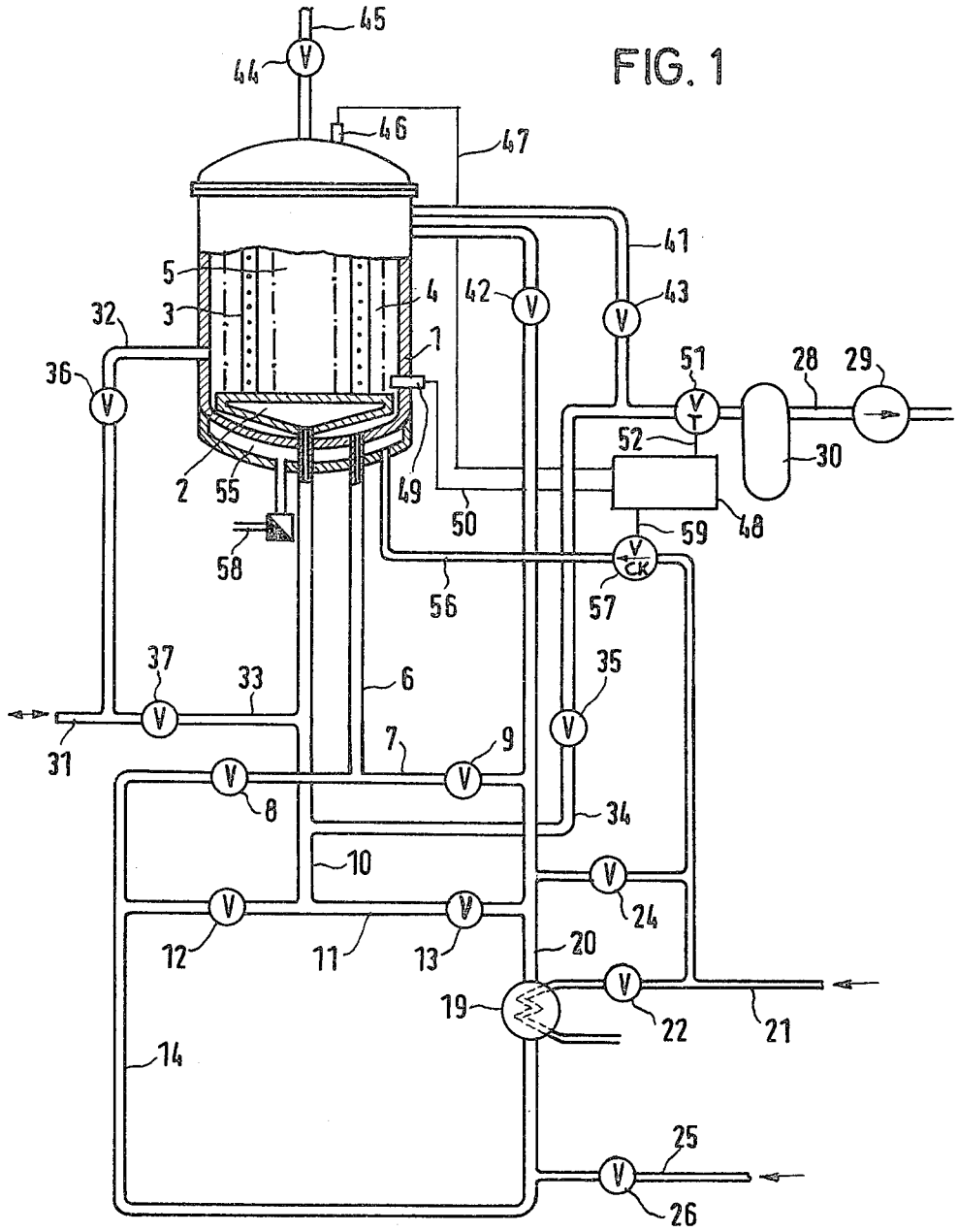
FIG. 1 is a schematic view of a first apparatus for treating fiber material, having an upright container and a plurality of stationary vertical material holders.

As per FIG. 1, an inner chamber is delimited within the lower section of container 1, with vertically arranged perforated tubes 3 resting upon the upper delimiting wall of a chamber 2, with, as indicated, the yarn bobbins to be treated being set upon said tubes 3 and said tubes 3 being arranged within the outer chamber 5 of container 1. In this manner, the inner chamber 2 and outer chamber 5 are in communication through the perforated tubes only by means of the fiber material 4 undergoing treatment. A line 6 serves to connect the outer chamber 5 with a line 7 that is provided with shutoff valves 8 and 9. The inner chamber 2 is connected in a corresponding manner by line 10 to line 11 provided with shutoff valves 12 and 13.

Lines 7 and 11 are connected with their left-hand ends to a line 14 transiting through air preheater 19 into a line 20, and lines 7 and 11 are joined at their right-hand ends to said line 20. A steam-feed line 21 supplying the required thermal energy is connected through a valve 22 to air preheater 19, and connected through a valve 24 to line 20. A compressed-air supply line 25 is, furthermore, connected through a shutoff valve 26 to line 14. The air preheater 19 may also be used to preheat the entire system.

The treatment fluid is supplied through line 31, which is connected to the outer container chamber 5 through branch line 32 and shutoff valve 36, and connected to line 10, and thus to the inner container chamber 2, through branch line 33 and shutoff valve 37.

In a similar manner, an evacuation line 28, having installed in it a vacuum pump 29 with condenser 30 at the container side, is connected through a branch line 34 and shutoff valve 35 to line 10 and thus to inner container chamber 2, as well as connected through a further branch line 41 and shutoff valve 43 to the upper end of the outer container chamber 5. Line 20, originating from air preheater 19 is also joined with its upper end thereat, with shutoff valve 42 being installed before this junction. A venting line 45 with shutoff valve 44 is also joined to the upper end of container 1.

A pressure sensor 46, connected by a signal line 47 to a control unit 48, projects into the upper end of external container chamber 5. In a similar manner, a temperature sensor 49, arranged in the lower zone of, respectively, perforated tubes 3 and the treated fiber material 4, is also connected by signal line 50 to the control unit 48. An adjustable throttle valve 51 is interposed in evacuation line 28 between vacuum pump 29 and the branching into lines 34 and 41, said throttle valve 51 being adjustable via a control line 52 to maintain, respectively, the predetermined pressure or subatmospheric pressure at which the desired partial evaporation is to ensue.

Below container 1, there is provided a heating jacket 55, to which is joined a steam line 21, connected to steam line 56 and containing regulating valve 57. A condensate drain 58 originates at the bottom of heating jacket 55. Alternatively, steam line 56 may, just as line 6, lead directly into outer chamber 5 and/or, as line 10, directly into inner chamber 2. Regulating valve 57 will be adjusted by control unit 48 over a control line 59, that the treatment fluid present within container 1 is essentially maintained at a predetermined temperature that is monitored with the aid of a temperature sensor 49. In given instances, requisite heating of the treatment fluid may also ensue by introducing into the treatment fluid through line 6 such quantities of steam that are of the required heat content. Supply of heat to compensate thermal losses, particularly from partial evaporation, will, when ensuing through the bottom side of container 1, contribute in an advantageous manner to steam forming in an essentially uniform distribution throughout the entire fluid volume, since in this manner the lower fluid strata, with a somewhat higher fluid pressure prevailing therein, may also be of a somewhat higher temperature, thus aiding in steam bubble formation.

After preheating the system and evacuating container 1, the treatment fluid is filled into container 1 through branch line 32 and/or 33, until the treatment fluid completely covers the fiber material 4 undergoing treatment. Subsequently, pressure within container 1 is reduced by means of vacuum pump 29, and through the opened branch line 41, to a value of, for instance, from 0.3 to 0.6 ata, with the predetermined pressure value being adjusted with the aid of control unit 48. At this subatmospheric pressure, correlated to the fluid temperature, partial evaporation of the fluid will take place, essentially within all zones of, respectively, fiber materials or bobbins 4 that are saturated with fluid. Evaporation will result in an intensive motion and agitation of the fluid, so that the finishing process is accelerated thereby and may be completed within a few minutes. To compensate thermal losses from partial evaporation, heat is supplied to the fluid within container 1, either by supplying steam to heating jacket 55, supply being controlled herein by regulating valve 57 in dependence upon the temperature determined by sensor 49, and/or by directly introducing steam into the treatment fluid. In given instances, pulsating of the treatment fluid to intensify fluid distribution and uniform activity, may be attained by alternatingly lowering and raising the pressure within container 1. The fluid may, therein, perform a kind of swinging motion combined with a partial motion of liquor, so that the fiber material will remain below the fluid level within container 1 (partial pulsation).

In given instances, the phase of activity at partial evaporation of the fluid, may be repeated after withdrawal and re-introduction of excess treatment fluid. Furthermore, the fiber material within container 1 may be subjected to intensive rinsing by intermittent mechanical dewatering and vacuum impregnation with fresh water.

Finally, the apparatus is so designed that the finished material, particularly chemical-fiber material, may be dried within the shortest time by means of hot air and/or an air/steam mixture being forced through it, as known from the initially noted Letters Patent. The piping layout as provided herein will, in conjunction with the respective valves, offer the possibility of performing within container 1 all process phases that may come into consideration. With the valves being in requisite operating position, it will particularly be possible to subject the fiber material alternatively to flow from the inside outward, i.e. from chamber 2 to chamber 5, or from the outside inward, i.e. from chamber 5 to chamber 2.

Figure 2:
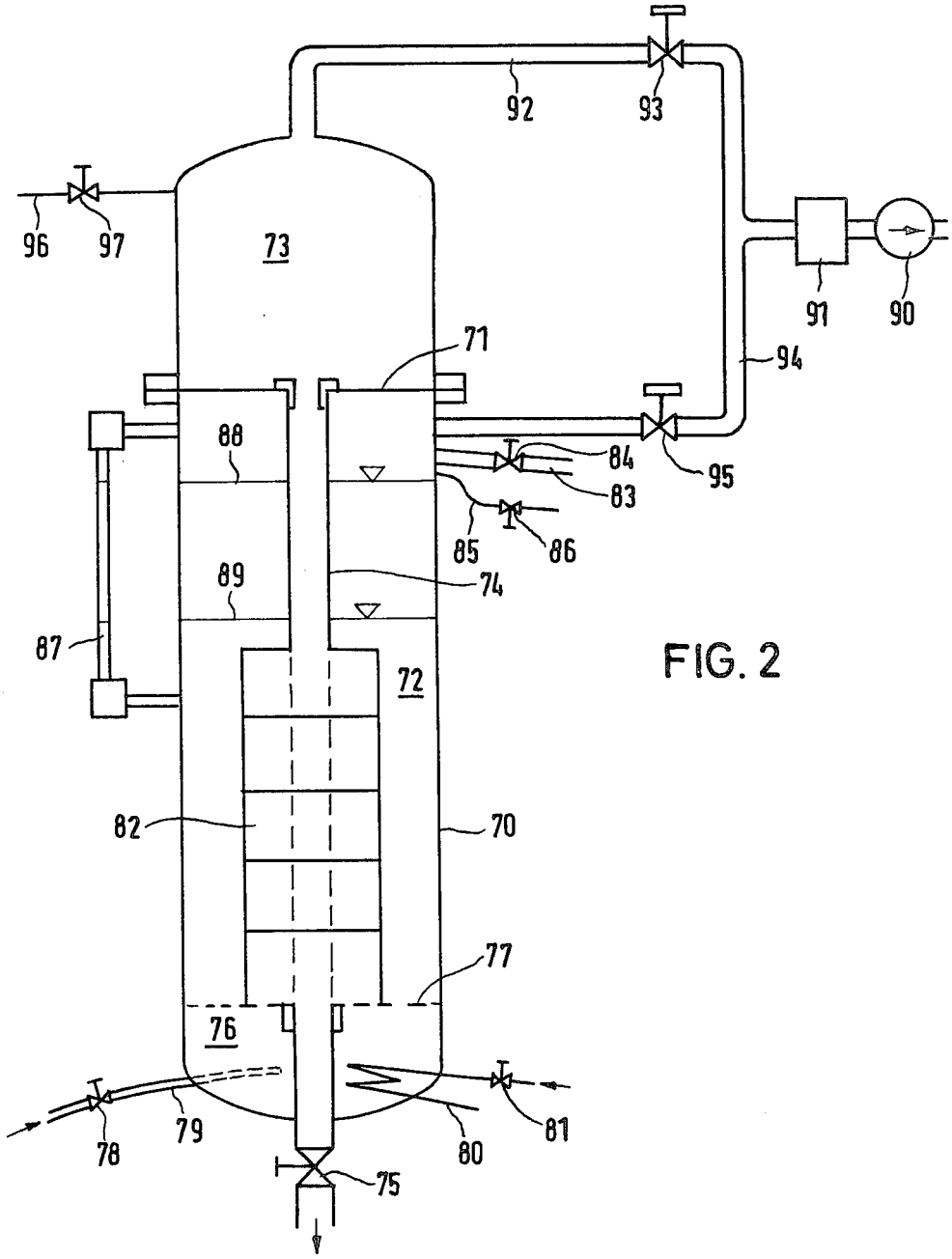
FIG. 2 is a schematic view of a second apparatus with a stationary vertical material holder for crosswound bobbins, said apparatus being also arranged for pulsating fluid activity.

As per FIG. 2, there is provided a container 70, divided by bottom 71 into chambers 72 and 73. A tubular material holder 74 extends through chamber 72, joined at its upper end to chamber 73 and led downward out of container 70, and is provided with a shutoff valve 75. A heating chamber 76 is formed at the lower end of container 70, communicating through perforated plate 77 with chamber 72. A steam line 79, provided with a shutoff valve 78, serving for the direct introduction of steam into container 70, terminates in heating chamber 76. There is, furthermore, provided a steam line 80 with a shutoff valve 81, said steam line 80 forming a heat exchanger within heating chamber 76, so that container 70 may also be supplied with steam heat, without the steam flowing out into container 70.

Within the zone of chamber 72, material holder 74 is provided with a perforated section, with crosswound bobbins 82 being placed thereupon. A compressed-air line 83 with shutoff valve 84, as well as steam line 85 with shutoff valve 86, are joined to the upper end of chamber 72. Provision is, furthermore, made for a level gage 87 to indicate the fluid level in chamber 72. The upper fluid level 88 and the lower fluid level 89 are indicated and with a pulsating effect exerted upon the fiber material of crosswound bobbins 82, the fluid level will fluctuate between said two gage levels.

Vacuum pump 90 with condenser 91 in line before it, is connected to chamber 73 through branch line 92 and shutoff valve 93, and with the upper end of chamber 72 through a parallel branch line 94 and shutoff valve 95. Furthermore, a steam line 96 with shutoff valve 97 is connected to chamber 73.

The apparatus as per FIG. 2 is operated in such a manner that vacuum impregnation at approx. 60° C. is performed with treatment fluid supplied from below through the initially opened shutoff valve 75. Venting is then continued for several minutes, with the remaining air escaping out of the fiber material in bubbles, this, since the bubbles expand in the vacuum. Improved conditions for diffusion will result thereby. Rapid preheating by directly introduced steam follows thereupon, aided by a pulsating fluid activity achieved by the alternating generation of a positive and a negative pressure differential between chambers 72 and 73, and resulting from alternatingly opening and closing shutoff valves 93 and 95 that are appurtenant to vacuum pump 90. Partial evaporation of the fluid will, as already described, ensue concomitantly. Perfect dyeing within a short period is thus ensured without liquor circulation and with stationary crosswound bobbins 82.

Figure 3:
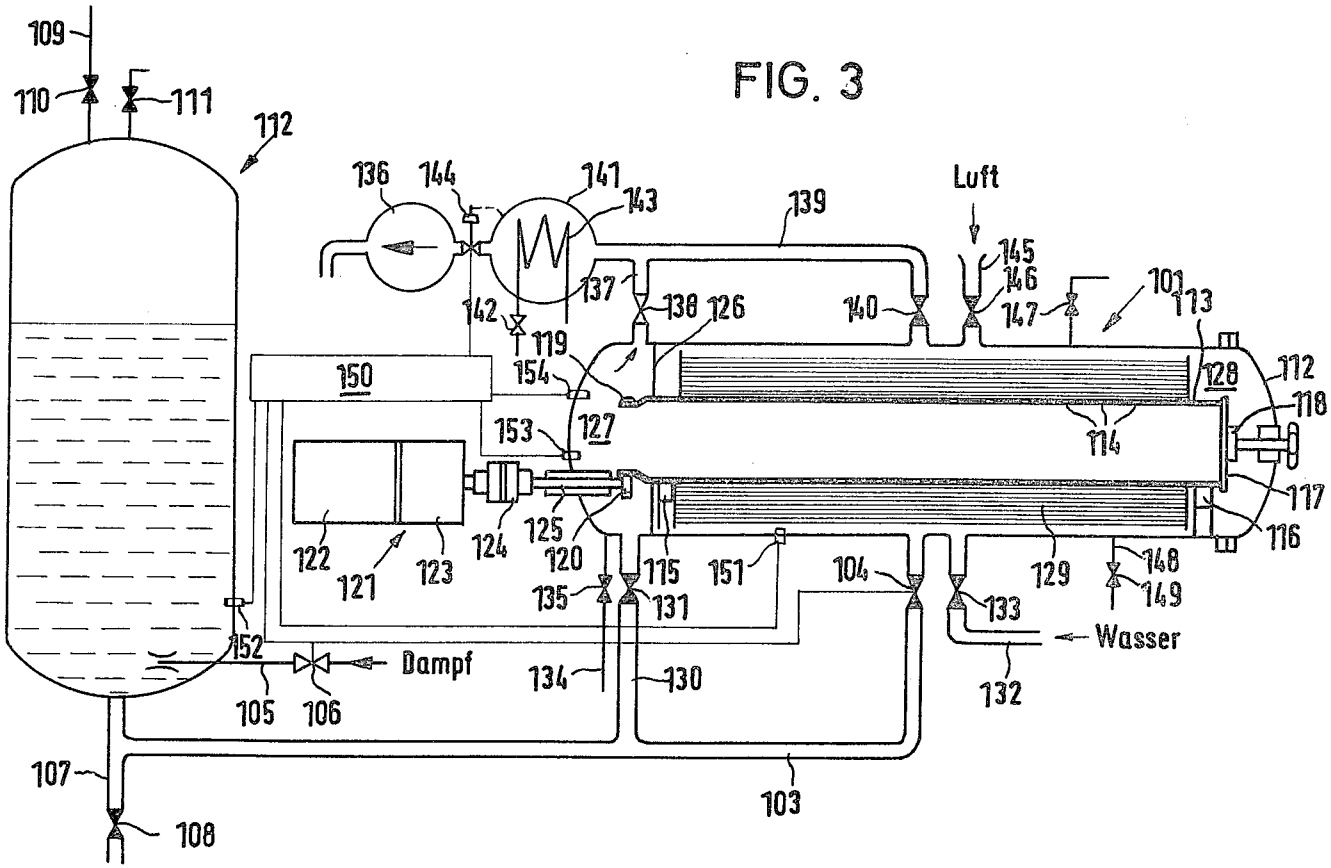
FIG. 3 is a schematic view of a third apparatus with horizontal treatment container provided with a rotatable horizontal material holder.

As can be seen from FIG. 3, the third apparatus comprises a longitudinally extending cylindrical treatment container 101 arranged with a horizontal axis, and a fluid reservoir 102 arranged with a vertical axis. Container 101 and reservoir 102 are in communication through an overflow valve 104.

A steam line 105 with steam valve 106 ends in the lower zone of reservoir 102. A line 107 with a valve 108, serving to fill the reservoir with the treatment fluid for instance a dyeing liquor, and also to drain the treatment fluid, originates from the bottom of reservoir 102. Overflow line 103 is connected to line 107. Furthermore, there are shown in the drawing, at the upper end of reservoir 102, a compressed air line 109 with compressed air valve 110, and a venting valve 111.

The treatment container 101 has, at its right-hand end, a charging aperture provided with a cover-like closure 112. A longitudinally extending cylindrical holder 113, with perforations arranged on its barrel, is coaxially and rotatably arranged within treatment container 101 resting upon bearing-type supports 115 and 116. The right-hand end of holder 113 is closed by a face plate 117 abutted by an adjustable retainer 118 that may be removed by means of closure 112 and serves to prevent axial displacement of holder 113. At its left-hand end, holder 113 is provided with an external gear ring 119 which is in mesh with pinion 120 of a drive arrangement 121 comprising, in turn, a motor 122 with transmission 123, coupling 124 and drive shaft 125, said drive shaft 125 extending through, and supported in the integrally attached end plate of treatment container 101, and carrying the pinion 120.

Within container 101, there is provided an annular bulkhead 126 radially extending between the barrel of treatment container 101 and holder 113, thus dividing container 101 into a drain chamber 127 at the right-hand end of container 101 and a fiber-material chamber 128. Since holder 113 is open at its left-hand end that carries ring gear 119, the interior of cylindrical holder 113 forms a central extension of drain chamber 127. Chambers 127 and 128 are in flow communication only through the perforations 114 of holder 113.

As shown, the fiber material 129 undergoing treatment, is wound in layers onto holder 113, and since the perforations 114 are provided only in the axial zone covered by fiber material 129, the flow between chambers 127 and 128 will, apart from perforations 114, communicate only through the fiber material 129.

Overflow line 103 with overflow valve 104 ends, as shown, into fiber material chamber 128 at the bottom side of container 101. Overflow line 103 is, however, also connected through branch line 130 and valve 131 to drain chamber 127.

Furthermore, a rinsing-water line 132 with rinsing valve 133, ends in fiber material chamber 128 at the bottom side of container 101. There is also provided a separate drain line 134 with a drain valve 135, originating at the lower end of drain chamber 127.

Treatment container 101 has, furthermore, appurtenant to it, a vacuum pump 136 connected to drain chamber 127 through suction line 137 with suction valve 138. Suction line 137 is also connected to fiber material chamber 128 through auxiliary suction line 139 and auxiliary suction valve 140. Between the branchoff of auxiliary suction line 139 and vacuum pump 136, there are interposed, in suction line 137, a heat exchanger 141 with a heat-exchanger coil 143 provided with a valve 142, as well as a throttle valve 144 serving to adjust to a desired value the pressure produced by vacuum pump 136 within drain chamber 127.

Furthermore, an air line 145 with air valve 146 ends at the topside of container 101, into the fiber material chamber 128. In given instances, preheated air may be supplied through this air line 145. A venting valve 147 as well as a drain line 148 with drain valve 149 are, furthermore, connected to container 101 in the zone of the fiber material chamber 128.

A control unit 150 is provided for controlling the apparatus which, however, may in given instances also be partially be controlled by hand. As schematically indicated, control unit 150 is connected via signal lines to a temperature sensor 151 within treatment container 101, and to a temperature sensor 152 within reservoir 102, as well as to a fluid level sensor 153 and a pressure sensor 154 within drain chamber 127. Furthermore, there extend from control unit 150 control lines which, for the sake of clarity, have not been shown as leading to all valves to be operated, but only leading to throttle valve 144 and, respectively, to overflow valve 104 and steam valve 106. These control lines, as shown, serve to regulate pressure and temperature of the fluid during its partial evaporation.

Operation of the apparatus is explained below: At the beginning of the process, the treatment fluid (dyeing liquor) has been filled into reservoir 102. Valves 104, 108, 131, 133, 140 and 146 are closed, as indicated in FIG. 3. The dyeing liquor is heated by steam feed to, for instance, 135° C. and a pressure of 3 bar. Vacuum pump 36 will suck air out of treatment container 101 as well as out of the fiber material 129 located on holder 113. A vacuum of, for instance, 80% is generated thereby within treatment container 101. Simultaneously, holder 114 with fiber material 129 is being slowly rotated by means of drive arrangement 121, for instance at one to two revolutions per minute.

In the second phase, the overflow valve 104 is opened, so that the dyeing liquor will flow into treatment container 101. Due to pressure conditions, the dyeing liquor will rapidly flow into the treatment container, for instance within only 100 seconds, and penetrate through fiber material 129 and perforations 114 into the drain chamber 127. Pressure in the reservoir 102 continues to be maintained at 3 bar and an identical pressure valve prevails within fiber material chamber 128 and external to fiber material 129. Due to vacuum pump 136 and requisite regulation by throttle valve 144, a lower pressure, for instance approximately of 2.9 bar, is maintained in drain chamber 127. This pressure differential will manifest itself in differing fluid levels within drain chamber 127 and fiber material chamber 128. Continual rotation of holder 113 will be maintained. In given instances, the direction of flow may be reversed by opening valves 131 and 140 instead of valves 104 and 138. It may also be appropriate in given instances, to effect pulsating flow by, for instance, opening valves 104 and 138 for 20 seconds, and valves 131 and 140 for ten seconds.

Dyeing is then, for instance, performed isothermically. Therein, holder 113 will, for instance, be rotated at two to three revolutions per minute. Steam valve 106 is partially opened so that steam may be introduced in such a quantity that the predetermined dyeing temperature of, for instance, 135° C. will be maintained. This temperature will also prevail within the fiber material 129. The dyeing liquor will be boiling thereat and penetrate the fiber material at a relatively high diffusion rate. Water vapor is being withdrawn from drain chamber 127 at approximately 2.9 bar and 133° C. Pressure within heat exchanger 141 will be at approximately 2.85 to 2.90 bar. This dyeing process, during continual boiling of the dyeing liquor, will ensue for a period of 5 to 10 minutes or longer.

Optionally, the dyeing process may be performed at gradually reduced pressure and falling temperature. Herein, valves 104 and 138 are closed and auxiliary suction valve 140 is open. This dyeing process may be performed for 5 to 10 minutes or longer. It will be appropriate to operate in a manner whereby a uniform temperature within every fiber-material layer is ensured in short intervals of, for instance, one minute. It is natural that holder 113 with fiber material 129 will be rotated also during this process phase.

The following process phase concerns draining of the hot dyeing liquor. Therein, suction valve 138 as well as auxiliary suction valve 140 are closed, valves 104, 108 and 131 are, however, open. At temperatures below 100° C., air valve 146 will also be opened.

Rinsing and dewatering of the fiber material within treatment container 101 constitutes the final process phase. Herein, valves 133, 138 and 146 are open, with the rinsing water being present only in the lower zone of the container, while air is being drawn through the upper zone. Holder 113 with fiber material 129 continues to be rotated herein as well, so that the sections of the fiber material as sequentially arranged in the circumferential direction will, alternatingly, be rinsed and dewatered. The vacuum pump 136 may, herein, also be used for withdrawing of rinsing water. Rapid draining of rinsing fluid is effected with valves 104, 131 and 146 open. A brief extraction of moisture from the fiber material 129 is then effected by opening only valves 138 and 146.

Figure 4:
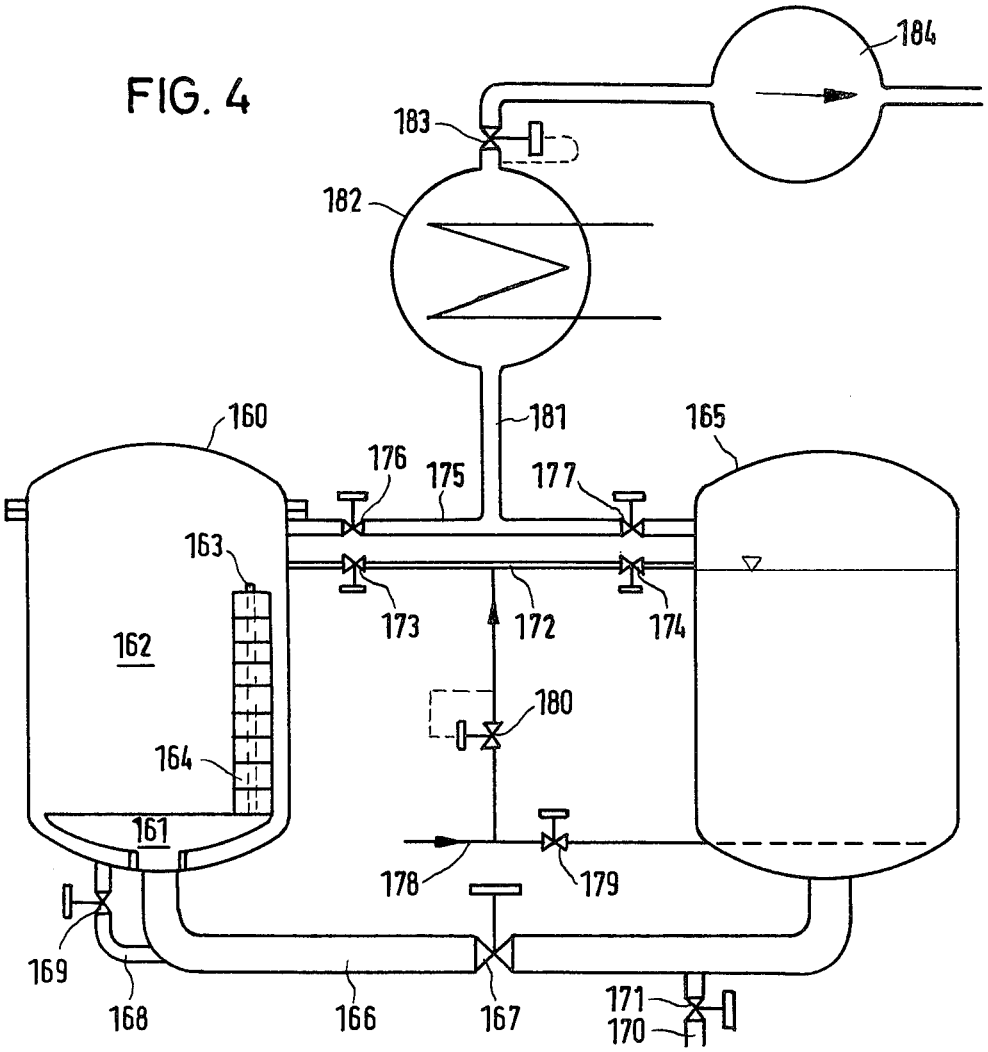
FIG. 4 is a schematic view of a fourth apparatus with two containers for the dyeing of crosswound bobbins, with steam-induced pulsating motion of the dyeing liquor during partial evaporation.

As per FIG. 4, the fourth apparatus comprises a treatment container 160 subdivided, as is container 1, in FIG. 1 into an inner chamber 161, an outer chamber 162 with perforated holders 163 for crosswound bobbins 164 arranged therein, and, furthermore, a fluid container 165. The two containers 160 and 165 are in communication at their lower ends by a fluid line 166 with a valve 167. Fluid line 166 ends, as shown, directly in inner chamber 161, it is, however, also connected with outer chamber 162 of container 160 via branch line 168 and valve 169. A supply and drain line 170, with a valve 171, is joined to fluid line 166 at the side of valve 167 connected to fluid container 165.

The two containers 160 and 165 are, in their upper zone, in communication by means of steam line 172 containing valves 173 and 174, and also by evacuation line 175 containing valves 176 and 177. A steam supply line 178 leads via valve 179 to the lower zone of fluid container 165, and also, via regulating valve 180, to the central sector of steam line 172 located between valves 173 and 174.

A line 181 is joined to the central sector of evacuating line 175 between valves 176 and 177, and contains, in the direction of flow, first a condenser 182 with regulating valve 183, and after same a vacuum pump 184.

This apparatus may be operated as follows: Initially, the dyeing liquor is introduced into fluid container 165 via line 170, with valve 176 closed and valve 171 open, whereupon valve 171 is re-closed, and the liquor within container 165 brought to desired temperature by introducing into the fluid heated steam via the open valve 179. After opening of valve 167, the fluid will flow through fluid line 166 into treatment container 160 into which the crosswound bobbins 164 have been loaded for dyeing. Valve 176 is open to avoid backpressure. After the fluid level in treatment container 160 has risen above the crosswound bobbins 164, the dyeing liquor in treatment container 160 is made to boil slowly by a gradual reduction in container pressure, and this may also be accomplished solely by means of condenser 182 and regulating valve 183, without having to use vacuum pump 184. The effect of the liquor upon the fiber material of crosswound bobbins 164 is intensified by the formation and rinsing of steam bubbles within the liquor, and by the agitation of the liquor caused thereby. The dyeing process is, furthermore, accelerated by alternating short opening and closing of, respectively, valves 173, and 174 in steam line 172, which will impart a pulsating motion to the liquor within treatment container 160.

With requisite valve setting and by utilizing the pressure of the steam present in line 178 and, in given instances, also utilizing the suction effect of vacuum pump 184, the apparatus will offer the availability of performing the dyeing process in several phases by returning the dyeing liquor from treatment container 160 through fluid line 166 into fluid container 165, so that the aforedescribed process may then be repeated. Complete draining of treatment container 160 is made by opening valve 169 in branch line 168. After completion of the dyeing process, the liquor may also be completely withdrawn through line 170.

We claim:

1. Process for the liquid treatment of fiber material, of yarn, or textile piecegoods, or paper goods, wherein the fiber material is brought into a container and the fluid in preheated state is filled into the container, after the container has been evacuated, with the fiber material being impregnated thereby, including the step of controlled continuous partial topical evaporation to impart a motion to the fluid and thus bringing the fluid to act upon the fiber material without the requirement for mechanically induced flow.

2. Process as per claim 1, said partial evaporation being regulated by controlled pressure reduction within the container.

3. Process as per claim 2, the pressure reduction within the container being obtained by condensation of steam withdrawn from the container.

4. Process as per claim 2 or 3, including the step of subjecting the fluid filled into the container to superatmospheric pressure and heating to above 100° C. prior to obtaining partial evaporation of the fluid by pressure reduction.

5. Process as per one of the claims 1 to 4, including the step of heating during said partial evaporation, the fluid filled into the container to such a degree which will compensate for cooling during the partial evaporation.

6. Process as per claim 5, wherein introduction and condensation of steam is used to heat the fluid filled into the container.

7. Process as per one of the claims 1 to 6, further including the step of imparting to the fluid filled into the container a pulsating motion during said partial evaporation or acting upon the fiber material.

8. Process as per claim 7, wherein the pulsating motion is obtained by introducing steam in inpulses.

9. Process as per one of claims 1 to 8, including the step of imparting to the fiber material during the partial evaporation, a continual and slow circulating motion through the container.

10. Process as per claim 9, including the steps of partially filling the container with fluid and displacing the fiber material along an essentially vertical circulation path, with the fiber material alternatingly being submersed into the fluid and raised out of it.

11. Process as per claim 9 or 10, wherein, upon completion of the fluid treatment, the fluid is withdrawn from the container and the treated fiber material is rinsed within the container, and is dewatered therein by evacuating the container and/or by blowing through of air, said rinsing being performed with the container only partially filled with rinsing water, and with simultaneous dewatering, so that the fiber material, when travelling along its essentially vertical circulation path, will alternatingly be rinsed within the lower container zone and dewatered within the upper container zone.

12. Process as per one of the claims 1 to 11, wherein the fiber material is dried subsequent to draining the container of excess fluid, the fiber material being first de-moistened by mechanical means and then dried by means of heated air being drawn through.

* * * * *